US011326131B2

(12) United States Patent
Tangestani-Nejad et al.

(10) Patent No.: US 11,326,131 B2
(45) Date of Patent: May 10, 2022

(54) CLEANING COMPOSITION

(71) Applicant: AMITY LIMITED, Barnsley (GB)

(72) Inventors: Mokhles Tangestani-Nejad, Barnsley (GB); Ram Singh, Barnsley (GB)

(73) Assignee: AMITY LIMITED, Barnsley (GB)

( * ) Notice: Subject to any disclaimer, the term of this patent is extended or adjusted under 35 U.S.C. 154(b) by 0 days.

(21) Appl. No.: 16/151,787

(22) Filed: Oct. 4, 2018

(65) Prior Publication Data

US 2019/0031980 A1 Jan. 31, 2019

Related U.S. Application Data

(63) Continuation of application No. 14/159,806, filed on Jan. 21, 2014, now abandoned, which is a continuation of application No. 12/922,205, filed as application No. PCT/GB2009/000682 on Mar. 13, 2009, now abandoned.

(30) Foreign Application Priority Data

Mar. 13, 2008 (GB) ..... 0804664

(51) Int. Cl.

| | |
|---|---|
| ***C11D 3/48*** | (2006.01) |
| ***C11D 1/645*** | (2006.01) |
| ***C11D 1/835*** | (2006.01) |
| ***C11D 3/10*** | (2006.01) |
| *C11D 1/40* | (2006.01) |
| *C11D 1/62* | (2006.01) |
| *C11D 1/72* | (2006.01) |

(52) U.S. Cl.

CPC ..... *C11D 3/48* (2013.01); *C11D 1/645* (2013.01); *C11D 1/835* (2013.01); *C11D 3/10* (2013.01); *C11D 1/40* (2013.01); *C11D 1/62* (2013.01); *C11D 1/72* (2013.01)

(58) Field of Classification Search

CPC .. C11D 3/48; C11D 3/10; C11D 1/835; C11D 1/645; C11D 1/40; C11D 1/62; C11D 1/72

See application file for complete search history.

(56) References Cited

U.S. PATENT DOCUMENTS

| | | | | |
|---|---|---|---|---|
| 4,098,877 | A | 7/1978 | Ball et al. | |
| 6,001,790 | A | 12/1999 | Schmidt et al. | |
| 2003/0199410 | A1 | 10/2003 | Besse et al. | |
| 2005/0089496 | A1 | 4/2005 | Lichtenberg et al. | |
| 2006/0035808 | A1 | 2/2006 | Ahmed et al. | |
| 2008/0194518 | A1* | 8/2008 | Mookerjee ..... | A01N 27/00 514/55 |
| 2008/0214420 | A1 | 9/2008 | Manabe et al. | |

FOREIGN PATENT DOCUMENTS

WO 2004101725 A 11/2004

OTHER PUBLICATIONS

Sigma Aldrich listing for potassium carbonate, retrieved Apr. 2, 2018 (Year: 2018).

Washing soda description, retrieved Apr. 2, 2018 (Year: 2018).

Richard L. Ward and Carol S. Ashley, pH Modificationof the Effects of Detergents on the Stability of Enteric Viruses, Applied and Environmental Microbiology, Aug. 1979, pp. 314-322.

International Search Report for PCT/GB2009/000682 dated Sep. 16, 2009.

Rosso, L., et al., Convenient Model to Describe the Combined Effects of Temperature and pH on Microbial Growth, Appl. Environ. Microbiol, 1995, 61(2):610.

* cited by examiner

*Primary Examiner* — Sarah Pihonak
*Assistant Examiner* — Jason Deck
(74) *Attorney, Agent, or Firm* — Heslin Rothenberg Farley & Mesiti P.C.

(57) ABSTRACT

A cleaning and disinfecting composition comprises a long-chain alkyl polyamine, such as dodecyl dipropylene triamine; a long-chain quaternary ammonium salt, such as N,N-didecyl-N,N-dimethylammonium chloride; and a metal carbonate salt, such as potassium carbonate, all in aqueous solution. A sequestering agent, a long-chain alkyl polyethoxylate, an alkanolamine and an anti-corrosive agent may also be present. The composition has a pH of at least 11 when diluted to an in-use concentration, and may be used to clean and disinfect hard surfaces, such as medical, dental and surgical implements, walls, floors, sinks and hard furnishing surfaces, or soft surfaces such as bedding, upholstery or clothing. The composition is effective as a virucide, a sporicide, a bacteriocide, a fungicide, and against yeasts and moulds, without harming the substrate cleansed.

20 Claims, No Drawings

CLEANING COMPOSITION

CROSS-REFERENCE TO RELATED APPLICATIONS

This application is a continuation of U.S. application Ser. No. 14/159,806, filed on Jan. 21, 2014, which is a continuation of U.S. application Ser. No. 12/922,205 filed on Sep. 13, 2010, which is a national stage filing under section 371 of International Application No. PCT/GB2009/000682 filed on Mar. 13, 2009, and published in English on Sep. 17, 2009 as WO 2009/112843, and claims priority to GB application No. 0804664.1 filed on Mar. 13, 2008, the entire disclosure of all of these applications being hereby incorporated herein by reference.

BACKGROUND ART

The present invention relates to a liquid cleaning composition having a wide spectrum of activity against harmful organisms and microorganisms, including viruses. More particularly but not exclusively, it relates to such a composition for cleansing hard surfaces, including wares, medical implements, medical devices and surgical and dental instruments, and for cleansing soft surfaces, such as furnishing, carpeting and textiles.

There is increasing concern about the incidence of serious infections that are picked up in hospitals and other medical environments, both by patients and by staff. It is believed that a significant vector for such infections is imperfectly disinfected surfaces harbouring bacteria and/or viruses that are or have become resistant to existing surface cleaning agents and conventional topical disinfectants.

Bacteria such as MRSA (methicillin-resistant *Staphylococcus aureus*) and C. diff (*Clostridium difficile*) have become notorious for surviving routine cleaning regimes and lingering to infect further victims. In 2006, almost 6500 deaths in the UK were reported as being due to C. diff infection, an increase of around 69% on 2005. Since such bacteria and their spores are resistant to most antibiotics once they have entered the body, it is important that bacterial/sporal contamination of an area (or of a medical device, implement, etc) from an infected patient be eradicated before cross-infection can occur.

Mycobacteria, such as the bacterium causing tuberculosis, are also becoming a serious concern once more. Tuberculosis infection rates in the UK rose by about 11% in 2007. Again, resistant strains are suspected.

Viral infections, such as influenza (most notoriously "bird flu", avian influenza virus strain H5N1) and SARS (severe acute respiratory syndrome) are also believed to be at least in part linked to residual viral contamination of surfaces which have been incompletely cleaned and disinfected.

A further issue that frequently needs to be addressed is the removal from surfaces of mould, yeast or fungal contamination and other microflora/microfauna.

Additionally, while some progress has been made towards dealing with contamination by active bacteria, fungi, and the like, active spore cells are usually significantly tougher and more resistant to existing cleansing and disinfection methods and media. It would be particularly beneficial if a composition suitable for removal of bacteria, viruses and/or fungal contamination could also be made effective against spores, since spores may well be responsible for long-term re-infection, even after other microorganisms, including vegetative bacterial forms, have been scoured away.

While it is possible for media for cleansing hard surfaces, medical devices, surgical instruments and the like to be more aggressive than those used on a patient's person, one must still ensure that the cleansing medium does not damage the surface, device, etc, being cleaned. This has in the past prevented the use of compositions that might otherwise have been hygienically effective. Aerospace materials, such as aluminium alloys, require particular care to avoid corrosion. Media for cleaning and disinfecting soft surfaces (e.g. upholstery, carpeting, bedding and clothing) must also avoid damaging the material being cleaned; bleaching of textiles or carpets can be an issue, for example.

One further issue that must nowadays be considered is the long-term effect of cleaning compositions on the environment. Commonly used sequestering agents such as EDTA (ethylene diamine tetra-acetic acid) and NTA (nitrilotriacetic acid) are effective against dissolved calcium ions and other such species that might inhibit cleansing effects. However, they tend to pass unhindered through conventional sewage treatment and are not readily biodegradable. Residues from wash waters may contaminate watercourses or the like, and there is concern about their long-term environmental effects. It would therefore be beneficial if a cleaning composition were highly effective in the short term, but subsequently broke down readily in the environment.

It is hence an object of the present invention to provide a cleaning composition for hard surfaces, medical devices and instruments, surgical implements or the like which has bactericidal, virucidal, fungicidal and sporicidal properties, while obviating the above disadvantages of existing compositions. It is further an object of the present invention to provide such a composition that may be used on soft surfaces, such as textiles, carpeting or the like.

BRIEF SUMMARY OF INVENTION

According to a first aspect of the present invention, there is provided an aqueous surface cleaning and disinfecting composition comprising a long-chain alkyl polyamine compound, a long-chain quaternary ammonium salt, and a metal carbonate salt, wherein the composition has a pH in use of at least 11.

Preferably, said long-chain alkyl polyamine compound comprises a long-chain alkyl triamine compound.

Advantageously, said long-chain alkyl polyamine compound comprises a compound having the general formula $R^1—N((CH_2)_mNH_2)(CH_2)_nNH_2$, where $R^1$ is a linear or branched alkyl chain comprising at least eight carbon atoms, and each of m and n equals 2, 3 or 4.

The long-chain alkyl polyamine compound may have the general formula $R^1—N((CH_2)_mNH_2)_2$, i.e. m equals n.

Optionally, each of m and n equals three.

The $R^1$ moiety may comprise a linear or branched alkyl chain having between ten and sixteen carbon atoms, optionally twelve.

Preferably, said long-chain quaternary ammonium salt comprises a quaternary ammonium compound having two long alkyl chains each comprising at least eight carbon atoms.

Advantageously, said long-chain quaternary ammonium salt comprises a compound having the general formula $R^2R^3R^4R^5N^+X^-$, where each of $R^2$ and $R^3$ is a linear or branched alkyl chain comprising at least eight carbon atoms, and each of $R^4$ and $R^5$ is either a methyl or an ethyl group.

$R^2$ and $R^3$ may be identical alkyl chains.

Each of $R^2$ and $R^3$ may comprise between ten and sixteen carbon atoms, optionally twelve.

$R^4$ and $R^5$ may be identical alkyl groups, optionally methyl groups.

Preferably, the composition comprises an alkali metal carbonate.

Advantageously, the composition comprises potassium carbonate and/or sodium carbonate.

Preferably, the composition further comprises a sequestering agent.

Advantageously, said sequestering agent comprises an N-carboxylato-substituted amino acid salt.

The sequestering agent may comprise a bis-N-carboxylato-substituted amino acid salt.

Said amino acid may comprise a dicarboxylic acid.

Said amino acid may comprise glutamic acid.

Preferably, the composition also comprises a long-chain alkyl polyethoxylate compound.

Advantageously, the composition comprises a long-chain alkyl polyglycol ether.

Said long-chain alkyl polyethoxylate compound may comprise a linear or branched alkyl chain having between ten and twenty carbon atoms.

Said long-chain alkyl polyethoxylate compound may comprise a linear or branched alkyl chain having sixteen to eighteen carbon atoms.

Preferably, the composition comprises an alkanolamine.

Advantageously, said alkanolamine comprises an ethanolamine, optionally monoethanolamine.

Preferably, the composition comprises an anti-corrosive agent.

Advantageously, said anti-corrosive agent comprises benzotriazole.

Preferably, the ratio of the long-chain alkyl polyamine compound to the long-chain quaternary ammonium salt is between 2:1 and 1:2 parts by weight.

Advantageously, the ratio of said polyamine to said quaternary salt is at least 1:1 by weight.

The ratio of said polyamine to said quaternary salt may be 1.5:1 by weight or less.

Preferably, the ratio of the long-chain alkyl polyamine compound to the metal carbonate salt is between 4:1 and 1.5:1 parts by weight.

Advantageously, the ratio of said polyamine to said carbonate salt is at least 2:1 by weight.

The ratio of said polyamine to said carbonate salt may be 3:1 by weight or less.

Preferably, the ratio of the long-chain quaternary ammonium salt to the metal carbonate salt is between 3:1 and 1:1 parts by weight.

Advantageously, the ratio of said quaternary salt to said carbonate salt is at least 1.5:1 by weight.

The ratio of said quaternary salt to said carbonate salt may be 2:1 by weight or less.

The composition may comprise a laundry treatment composition, for example adapted to be administered to textile materials during a rinse cycle.

The composition may then also comprise an optical brightener.

The composition may then comprise a fabric conditioner composition.

According to a second aspect of the present invention, there is provided a method of cleaning and disinfecting a substrate, comprising the steps of providing a cleaning composition as described in the first aspect above and applying it to the substrate.

Preferably, said substrate comprises a hard surface.

Advantageously, said substrate comprises a hard furnishing surface, such as a bedstead, a cabinet, a basin, a toilet, an operating table or the like.

Said substrate may comprise a ceiling, wall or floor surface.

Alternatively, said substrate comprises a medical device, a medical instrument, a surgical implement, a dental tool or the like.

Said substrate may comprise a soft material.

Said soft material may comprise a furnishing material, such as curtaining, carpeting, bedding, upholstery or the like.

Said soft material may comprise clothing.

The method may comprise a laundering method, in which case the composition may be applied in a rinsing/conditioning step.

DETAILED DESCRIPTION

An embodiment of the present invention will now be more particularly described by way of example.

A first cleansing composition concentrate was made up, containing the following components per 100 kilograms (% w/w):

| | |
|---|---|
| Water | 54.075 kg |
| Dodecyl dipropylene triamine | 12.0 kg |
| Tetrasodium N,N-bis(carboxylatomethyl)-L-glutamate | 7.2 kg |
| N,N-didecyl-N,N-dimethylammonium chloride | 8.7 kg |
| $C_{16}/C_{18}$ fatty alcohol polyglycol ether | 5.0 kg |
| Potassium carbonate | 5.0 kg |
| Monoethanolamine | 8.0 kg |
| Benzotriazole | 0.025 kg |

The composition appeared as a clear colourless liquid with a pH of 12.6.

Dodecyl dipropylene triamine is a biocidally active material. Tetrasodium N,N-bis(carboxylatomethyl)-L-glutamate is a sequestering agent used to soften water by complexing calcium ions. It is believed to be readily biodegradable, possibly due to its glutamate skeleton, unlike conventional sequestering agents such as EDTA (ethylene diamine tetraacetic acid). N,N-didecyl-N,N-dimethylammonium chloride is a quaternary ammonium salt (or "quat") with detergent and disinfectant properties. Fatty acid polyglycol ethers are used as wetting agents and dispersants. Monoethanolamine is used as a buffering agent and also has wetting properties. Benzotriazole is a preservative which also has some anti-corrosive properties.

The above concentrate is used diluted with water to 10% of the above concentrations, at which point it has a pH of around 11.7, or even diluted a hundredfold to 1% w/w, at which point it has a pH of around 11.2.

At these working concentrations, the above composition is found not to be hazardous to human health. Tests have also shown that the composition is biodegradable in the short to medium term. Conventional compositions (which usually contain sequestering agents such as EDTA or NTA) may require specific labelling, as well as specific precautions to avoid them being washed into watercourses or the like. However, the above composition is found not to be persistent in the environment and it is believed that no such labelling will be required. (Good housekeeping principles would still discourage discharge into watercourses, but any unplanned releases would be unlikely to cause significant problems).

Testing on cleansing hard surfaces (including medical and surgical devices and instruments) and soft surfaces (including textiles and soft furnishing materials) contaminated with bacteria, viruses, fungi and even spores has shown a wide spectrum of efficacy.

Testing has been carried out against each of the following EN (European Norm) standardised tests for cleaning and disinfection:

| | |
|---|---|
| EN1275 | (applicable for fungi and yeasts); |
| EN1650 | (applicable for fungi and yeasts); |
| EN1276 | (applicable for bacteria, fungi, yeast and spores); |
| EN13727 | (applicable for bacteria in the presence of blood); |
| EN13697 | (applicable for bacteria and fungi - this test is carried out on actual samples of surfaces to be cleaned, rather than in the test-tube); |
| EN14347 | (applicable for spores - this is a particularly severe test as the spores are aged for four weeks before application of the test disinfecting medium, and are hence much tougher than those encountered in real life conditions); |
| EN14348 | (applicable for TB, a mycobacterium); |
| EN14476 | (applicable against viruses - test must include polio virus, the hardest RNA virus to destroy outside the body, and adeno virus, the hardest DNA virus to destroy outside the body); and |
| EN13704 | (applicable for spores). |

All these tests were passed with ease. Specifically:

| | |
|---|---|
| EN1275: | passed in 1 minute. |
| EN1650: | passed in 1 minute. |
| EN1276: | passed in 1 minute. |
| EN13727: | passed in 1 minute. |
| EN13697: | bacteria: passed in 5 minutes<br>fungi/yeast: passed in 15 minutes. |
| EN14347: | passed in 1 minute, even with fully aged spores. |
| EN14348: | passed in 1 minute, test requirement is 60 minutes. |
| EN14476: | passed with a log 5 (100,000 fold) reduction in 5 minutes; test requirement is a log 4 (10,000 fold) reduction in 60 minutes. |
| EN13704: | passed in 2 minutes; test requirement is 60 minutes. |

The individual components of the composition have been found not to have sporicidal effects, but the combination of the long-chain triamine and the quaternary ammonium salt, at the pH ranges used, appears to be sufficient to penetrate the tough outer layer of spores and kill them. Existing cleansing media have only had significant effect once spores have become vegetative bacteria, potentially leaving unharmed spores as a long-term reservoir of contamination.

The composition is also effective against so-called "naked" viruses, which are particularly resistant to existing disinfecting media. Examples of such viruses are polio, adeno, norovirus and canine parvovirus.

The dodecyl dipropylene triamine biocide used in the above composition has no effect on its own when tested against the polio virus. In the standard test, the above composition passes within five minutes, against a requirement allowing sixty minutes, indicating high effectiveness under realistic conditions of use.

A further benefit of the above composition over existing cleansing and disinfecting media is that it is not inactivated by organic soiling. Most or all existing media are substantially inactivated by the presence of blood, making it difficult to clean surgical instruments effectively, for example. Both quaternary ammonium salts and alkyl triamines suffer from this problem, when used on their own. Under the standard test EN13727:2003 "Chemical disinfectants and antiseptics. Qualitative suspension test for the evaluation of bacteriocidal activity of chemical disinfectants for instruments used in the medical area", the above composition is still fully effective in the presence of blood, achieving a pass score in only one minute.

Each of the above standard EN tests (except for EN14476) has been performed in both "clean" and "dirty" conditions. "Dirty" conditions are simulated by the addition of a 10% albumen loading. Nevertheless, the above composition passed the tests easily, even in "dirty" conditions.

It is important that a widely-usable cleanser and disinfectant should not attack the surfaces to which it is applied, including surfaces of medical devices and instruments, such as endoscopes and flexible endoscopes, surgical instruments and dental instruments. This has previously limited the use of cleansing media having particularly high (or low) pH values. However, when the above composition is tested under ASTM G 31-72:2004 "Standard Practice for Laboratory Immersion Corrosion Testing of Metals", it is found to be effectively non-corrosive. Even though a small level of benzotriazole anti-corrosive is present, in the composition, and monoethanolamine is known to have some anti-corrosive effect, this is a surprisingly significant effect. The above composition is hence not considered corrosive to metals under current EU directives, even though the concentrate reaches a pH of around 12.6 and even at 1% w/w dilution, it has a pH of 11.2.

It is also important that a cleanser/disinfectant for use on soft surfaces, such as upholstery, curtains, carpeting, bedding, clothing and the like, should not harm the surfaces to be cleaned. (For example, bleach can be an effective disinfectant, but will attack many fibres in textiles or carpeting, and bleach out dyestuffs). No such problems have been experienced with compositions embodying the present invention.

Compositions of the present invention also appear to be effective against contamination in laundry applications. The standard recommendation from the UK Department of Health and the World Health Organisation is that hospital clothing, bedding and the like should be washed at a temperature of 80° C. or greater, to ensure complete cleaning and disinfection. These temperatures, effectively a "boil wash", are likely to damage the textiles involved, shortening their lifetimes and making them uncomfortable in wear. The additional energy costs of washing at over 80° C. are also very significant, particularly as modern detergents can often clean (but not disinfect) at 30° C. to 40° C.

However, the above composition has been tested in the following wash cycle: wash with detergent conventionally at 30° C.-40° C.; rinse with water; rinse with a diluted form of the above composition; rinse again with water. This has given the same effectiveness in cleaning and disinfection as an 80° C. wash with detergent and water rinse alone. There would hence be major savings in both energy costs and the lifetime of the textiles being cleaned. Since the above composition is effectively biodegradable, the environmental concerns that might attend the use of existing cleansing/disinfecting media should not arise.

It hence appears that the cleansing and disinfecting composition of the present invention has unexpectedly broad and rapid effectiveness against all pathogens of particular current interest, without the drawbacks and side effects that might have been predicted.

The invention claimed is:

1. An aqueous surface cleaning and disinfecting composition comprising an alkyl triamine compound having the general formula $R^1—N((CH_2)_3NH_2)_2$, wherein the alkyl chain $R^1$ is a linear or branched alkyl chain comprising twelve carbon atoms; a quaternary ammonium salt having the general formula $R^2R^3R^4R^5N^+X^-$, where $R^2$ and $R^3$ are identical linear or branched alkyl chains comprising ten carbon atoms, $R^4$ and $R^5$ are methyl groups, and $X^-$ comprises a chloride ion; and potassium carbonate, wherein the composition has a pH in use of at least 11.

2. The aqueous surface cleaning and disinfecting composition as claimed in claim 1, further comprising a sequestering agent.

3. The aqueous surface cleaning and disinfecting composition as claimed in claim 1, also comprising an alkyl polyethoxylate compound, said alkyl polyethoxylate compound comprising a linear or branched alkyl chain having between ten and twenty carbon atoms.

4. The aqueous surface cleaning and disinfecting composition as claimed in claim 1, wherein ratio of the alkyl triamine compound to the quaternary ammonium salt is between 2:1 and 1:2 parts by weight.

5. The aqueous surface cleaning and disinfecting composition as claimed in claim 1, wherein ratio of the alkyl triamine compound to potassium carbonate is between 4:1 and 1.5:1 parts by weight.

6. The aqueous surface cleaning and disinfecting composition as claimed in claim 1, wherein ratio of the quaternary ammonium salt to potassium carbonate is between 3:1 and 1:1 parts by weight.

7. The aqueous surface cleaning and disinfecting composition as claimed in claim 1, wherein ratio of the alkyl triamine compound to the quaternary ammonium salt is between 2:1 and 1:2 parts by weight; ratio of the alkyl triamine compound to potassium carbonate is between 4:1 and 1.5:1 parts by weight; and ratio of the quaternary ammonium salt to potassium carbonate is between 3:1 and 1:1 parts by weight.

8. The aqueous surface cleaning and disinfecting composition as claimed in claim 1, wherein the composition is not inactivated by organic soiling.

9. The aqueous surface cleaning and disinfecting composition as claimed in claim 1, wherein the composition with a pH in use of at least 11 penetrates an outer layer of spores and kills the spores.

10. An aqueous composition as claimed in claim 2, wherein said sequestering agent comprises an N-carboxylato-substituted amino acid salt.

11. An aqueous composition as claimed in claim 10, wherein said amino acid salt comprises a dicarboxylic acid salt.

12. An aqueous composition as claimed in claim 11, wherein said dicarboxylic acid salt is tetrasodium N,N-bis(carboxylatomethyl)-L-glutamate.

13. An aqueous composition as claimed in claim 3, said alkyl polyethoxylate compound comprising a linear or branched alkyl chain having between sixteen and eighteen carbon atoms.

14. An aqueous composition as claimed claim 1, also comprising an alkanolamine.

15. An aqueous composition as claimed in claim 1, further comprising an anti-corrosive agent.

16. An aqueous composition as claimed in claim 1 further comprising:

tetrasodium N,N-bis(carboxylatomethyl)-L-glutamate.

17. An aqueous composition as claimed in claim 1 further comprising:

a sequestering agent, wherein said sequestering agent comprises an N-carboxylato-substituted amino acid salt and wherein said amino acid comprises a dicarboxylic acid;

an alkyl polyethoxylate compound, said alkyl polyethoxylate compound comprising a linear or branched alkyl chain having between ten and twenty carbon atoms;

optionally an alkanolamine; and optionally an anti-corrosive agent.

18. An aqueous composition as claimed in claim 1, wherein the composition comprises:

dodecyl dipropylene triamine;

N,N-didecyl-N,N-dimethylammonium chloride; and potassium carbonate.

19. An aqueous composition as claimed in claim 1, wherein the alkyl triamine compound comprises dodecyl dipropylene triamine; wherein the quaternary ammonium salt comprises N,N-didecyl-N,N-dimethylammonium chloride; and wherein the composition further comprises tetrasodium N,N-bis(carboxylatomethyl)-L-glutamate;

$C_{16}/C_{18}$ fatty alcohol polyglycol ether;

potassium carbonate; and benzotriazole.

20. The aqueous surface cleaning and disinfecting composition as claimed in claim 8, wherein the organic soiling includes the presence of blood.

* * * * *